US005755596A

United States Patent [19]

Watson

[11] Patent Number: 5,755,596

[45] Date of Patent: May 26, 1998

[54] HIGH-DENSITY COMPRESSION CONNECTOR

[76] Inventor: Troy M. Watson, 249 S. Kolb #G, Tucson, Ariz. 85710

[21] Appl. No.: 752,713

[22] Filed: Nov. 19, 1996

[51] Int. Cl.[6] ..... H01R 13/658

[52] U.S. Cl. ..... 439/608; 439/78; 439/943; 174/267

[58] Field of Search ..... 439/608, 55, 78, 439/733.1, 750, 943; 174/261, 267

[56] References Cited

U.S. PATENT DOCUMENTS

| | | | |
|---|---|---|---|
| 3,114,194 | 12/1963 | Lohs | 29/155.5 |
| 3,634,601 | 1/1972 | Pauza | 361/406 |
| 4,679,321 | 7/1987 | Plonski | 29/846 |
| 5,030,134 | 7/1991 | Plosser | 439/84 |
| 5,042,146 | 8/1991 | Watson | 29/845 |
| 5,250,759 | 10/1993 | Watson | 174/261 |

*Primary Examiner*—Gary F. Paumen

[57] ABSTRACT

A compression connector assembly for interconnecting microelectronic circuit and cable assemblies, which provides shielding and characteristic impedance control, and is configurable in high-density multi-connector arrays. In a first embodiment, the connector includes a bare-wire loop contact element rigidly maintained within a cylindrical sleeve closely received within a cylindrical receptacle of a conductive housing. In a second embodiment, the connector includes a bare-wire loop contact element closely received within a cylindrical receptacle of an insulating housing. In a third embodiment, the connector includes a contact element formed from two bare-wire segments bonded together and disposed within a cylindrical sleeve closely received within a cylindrical receptacle of a conductive housing. In a fourth embodiment, the connector includes a contact element formed from two bare-wire segments bonded together and closely received within a cylindrical receptacle of an insulating housing. In each embodiment, connector contact elements are either attached to the sleeve or housing, or float and are longitudinally movable.

18 Claims, 7 Drawing Sheets

SECTION A-A

SECTION B-B

HIGH-DENSITY COMPRESSION CONNECTOR

BACKGROUND OF THE INVENTION

1. Field of the Invention

The present invention relates to electrical connectors for interconnections among high-density and/or miniaturized electronic devices, circuit boards, and cabling assemblies. More particularly, the invention relates to a multi-unit connector assembly providing electrical contact and conduction by means of direct compression or surface contact, and able to be configured in high-density multi-connector arrays.

2. Description of the Related Art

Because present trends in designing microelectronic devices and circuits are toward increased miniaturization, higher component density and greater number of component leads per piece-part, there is a corresponding need for connectors that can be configured in high-density, large-number arrays. Techniques known in the art for providing high-density interconnections between an integrated circuit (IC) or multi-chip module (MCM) and a printed wiring board (PWB) include using a quad flat-pack (QFP) which surrounds an integrated circuit (IC) or multi-chip module (MCM) on four sides with wire/lead interconnections, and using a leadless chip-carrier (LCC) which surrounds the four outer planes of an IC/MCM with vertical, flush, interconnecting leads. High-density interconnection techniques wherein connections are arranged in a two-dimensional array located under or near the substrate of an IC/MCM or the base of a PWB include the use of land grid arrays (LGA's), ball grid arrays (BGA's), and pin grid arrays (PGA's). LGA's and BGA's have become popular in part because production equipment used to mount and solder surface-mount devices onto circuit boards can be easily adapted. This ease of manufacture is enhanced by the tendency of BGAs during soldering to self-align because of the effects of surface tension caused from the molten solder.

Chip-scale packaging is another emerging technique for interfacing an IC to a substrate/circuit board. Still in its infancy, this technology has the potential to cost-effectively provide direct connections between package or circuit board input/output (I/O) pads to IC die or MCM substrates.

Because circuit miniaturization and high-density components entail ever-increasing signal speeds and input/output rates, newly developed devices increasingly require interconnections that can provide adequate shielding and maintain a proper and uniform characteristic impedance. These properties are particularly necessary to pass low-noise signals or signals with fast edges ($\Delta v/\Delta t$). In PWB design, characteristic impedance control has been achieved by using strip-line or micro-strip techniques which requires careful control of the size, position and spacing of circuit traces within a dielectric away from a ground or reference plane. However, applying strip-line or micro-strip connections to the inner pads of a high-density PWB becomes more difficult as circuit density increases. Also, more layers and increased manufacturing must be used when a device includes numerous, high-density, shielded and/or impedance-controlled interconnections. Increased circuit density requires more connections per unit area, especially if numerous ground planes (as required when using micro-strips or strip-lines) are utilized.

U.S. Pat. No. 4,679,321 to J. P. Plonski describes an interconnection board for high frequency signals wherein connectors are in close proximity. The board is constructed having one side provided with a ground plane and the other side provided with terminal pads and interconnection conductors. Holes are drilled through the board at the terminal points. An end of the center conductor of a coaxial cable, stripped of insulation, is inserted through each hole while the conductive shield remains on the other side of the board. Each bare-wire conductor is connected to a pad and the conductors are scribed and bonded into place. The shields can be interconnected by applying a plated copper layer or a conductive encapsulating layer or by reflow soldering.

U.S. Pat. No. 3,114,194 to W. Lohs describes a method of wiring an electrical circuit upon an insulating plate provided with a plurality of holes, whereby wire lengths are kept as short as possible and wires can be crossed. Insulated wire is drawn through a hole in the plate and a loop formed from the wire projecting through the hole. The loop is then crushed to simultaneously anchor the loop into the hole and expose a conductive area.

My prior patent, U.S. Pat. No. 5,042,146 ("146"), discloses a process and apparatus for forming double-helix contact receptacles directly from insulated wire for interconnecting components independent of printed circuitry. Some of the apparatus disclosed therein, specifically the wire processing mechanism including cutting, stripping, and handling assemblies, is readily adaptable to the present invention which, like the "146" patent, is capable of handling and incorporating both single and twisted-pair insulated wire. Alternatively, coaxial cable can be used with the center conductor in lieu of a single conductor, provided the shield does not contact the center conductor.

My prior patent, U.S. Pat. No. 5,250,759 ("759") entitled "Surface Mount Component Pads", which is incorporated herein by reference in its entirety, discloses a method to form pads for surface-mount electronic components by inserting a stripped portion of insulated wire into an elongated rectangular opening, and anchoring the U-shaped loop thus formed into place with epoxy or a plug. Although the pads disclosed in the '759 patent can be used with area arrays, their elongated pads will not mesh well geometrically with the square pads normally used in arrays. In addition, due to their shape, elongated pads cannot be disposed sufficiently dense in planar arrays to meet the close proximity requirements of LGA's or BGA's.

OBJECTS OF THE INVENTION

Accordingly, it is a primary object of the present invention to provide a mechanically rugged multi-unit connector assembly for interconnecting electronic circuit and cable assemblies requiring high-density interconnections by means of compression of one contact element to another.

Another object of the invention is to provide a multi-unit connector capable of providing shielding between all elements of the connector array.

A further object of the invention is to provide a multi-unit connector assembly allowing limited control of the characteristic impedance of each signal in a high-density connector array, so as to improve circuit performance.

Yet another object of the invention is to provide a multi-unit connector that is simple to manufacture and repair.

Another object of the invention is to provide a multi-unit connector that is simple, reliable and easy to use.

Other objects of the invention will become evident when the following description is considered with the accompanying drawing figures. In the figures and description, numerals indicate the various features of the invention, like numerals referring to like figures throughout both the drawings and description.

SUMMARY OF THE INVENTION

These and other objects are achieved by the present invention, a compression connector assembly consisting of a plurality of wire loops situated in a multi-unit connector array. High-density can be achieved with this array, allowing an ability to interconnect to the newest microelectronic circuits and devices.

In a first embodiment, an electrical connector contact element is fabricated from a section of wire stripped of insulation and bent into a 180-degree loop to form a loop-end. A plurality of these loop-ends serving as individual electrical contact elements reside in individual insulating or conductive sleeves, with said sleeves either floating in or permanently attached to the inner receptacle walls of a generally cylindrical cavity of a housing composed of a conductive and/or magnetically permeable material.

In a second embodiment, an electrical connector contact element is fabricated from a section of wire stripped of insulation and bent into a 180-degree loop to form a loop-end. A plurality of these loop-ends serving as electrical contact elements are mounted in individual generally cylindrical cavities of an electrically insulating housing.

In a third embodiment, an electrical connector contact element is fabricated from two separate segments of wires stripped of insulation, the segments welded, soldered or otherwise bonded together, with the ends serving as an electrical connector contact element. A plurality of these contact elements reside in individual insulating or conductive sleeves, with said sleeves either floating in or permanently attached to the inner receptacle walls of a generally cylindrical cavity of a housing composed of a conductive and/or magnetically permeable material.

In a fourth embodiment, an electrical connector contact element is fabricated from two separate segments of wires stripped of insulation, the segments welded, soldered or otherwise bonded together, with the ends serving as an electrical connector contact element. A plurality of these contact elements are mounted in individual generally cylindrical cavities of an electrically insulating housing.

In each embodiment, a portion of each wire feeding the contact elements are either floating in or are permanently attached to the inner surface of its receptacle; in the case of the first and third embodiment, this wire is either floating in or bonded to the sleeve, while in the case of the second or fourth embodiment, this wire is either floating in or bonded to the insulating housing. When the contact element is configured as floating, an opposed pair of arcuately-shaped fingers or a U-shaped wire clamp closely receives and rigidly maintains the position of the contact element between the wire loop/wire segments. Electrical contact with the opposing contact element is achieved by extending the wire-loop of each embodiment forward until their mutual contact. When the contact element is compressed against the opposing contact element, a low-resistance path for electrical current flow is provided. In addition, the contact element in each embodiment can be plated with a noble metal or covered with an electrically conductive cap fabricated from a noble metal to serve as the contact element.

There can be three different positions where electrical contact to an opposing contact element can occur. In the first position, electrical contact occurs at pads near the surface of the housing, such as the need to connect to pads of a LGA or BGA device. In the second position, electrical contact occurs beyond the surface of the housing, such as a need to connect to an opposing connector element within a cavity. In the third position, electrical contact occurs within the receptacles cavity, such as the need to connect to male or extended pins that penetrate in order to connect.

A more complete understanding of the present invention and other objects, aspects and advantages thereof will be gained from a consideration of the following description of the preferred embodiments read in conjunction with the accompanying drawings provided herein.

DESCRIPTION OF THE PREFERRED EMBODIMENTS

I. INTRODUCTION

Figure 1A:
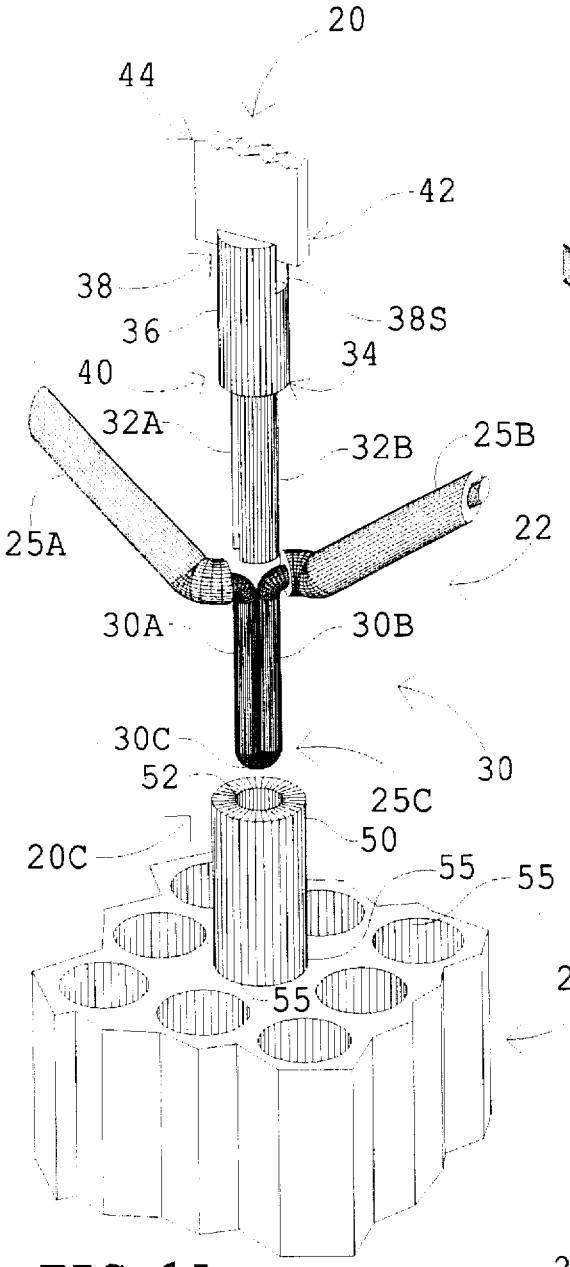
FIG. 1A is a partially exploded perspective view of a first embodiment according to the invention, a multi-unit connector assembly showing an exemplary connector of a wire loop, sleeve, and a fingers-and-shoulder sub-assembly attached to a longitudinally movable arm above a housing unit.
Figure 1C:
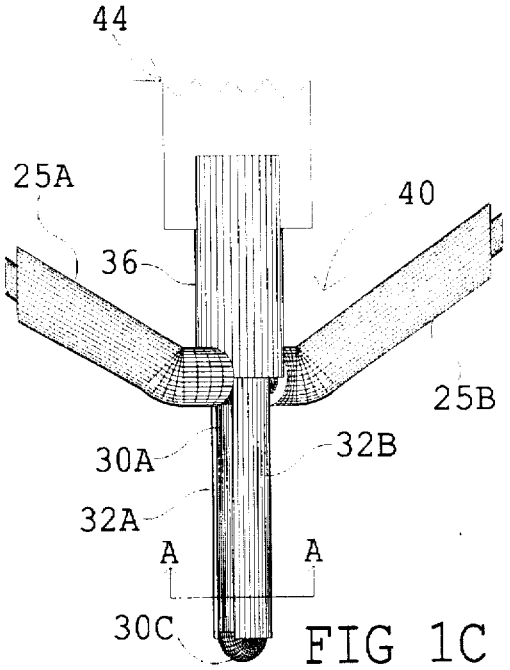
FIG. 1C is a side view of the FIG. 1A wire loop held by the fingers-and-shoulder sub-assembly.
Figure 1D:
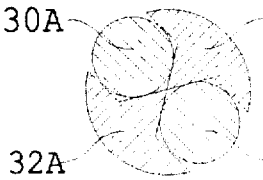
FIG. 1D is an enlarged cross-sectional view taken along line A—A of FIG. 1C.

While the present invention is open to various modifications and alternative constructions, the preferred embodiments shown in the drawings will be described herein in detail. It is to be understood, however, there is no intention to limit the invention to the particular forms disclosed. On the contrary, it is intended that the invention cover all modifications, equivalences and alternative constructions falling within the spirit and scope of the invention as expressed in the appended claims.

II. FIRST PREFERRED EMBODIMENT

Figure 1B:
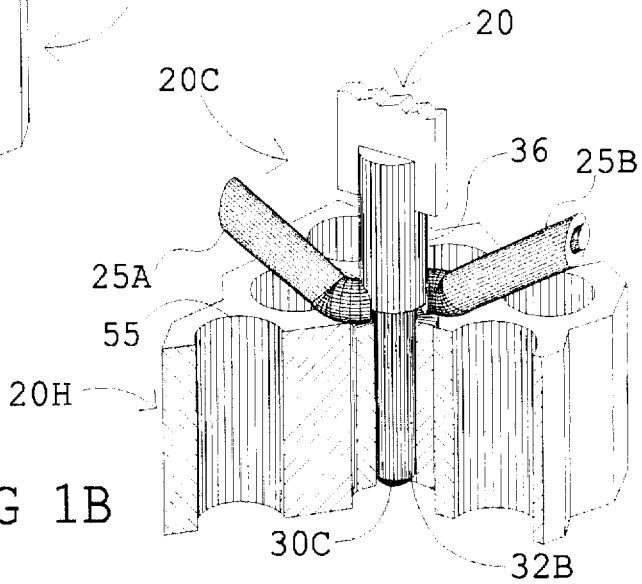
FIG. 1B is a partial sectional view of the FIG. 1A connector, housing, and arm.
Figure 2A:
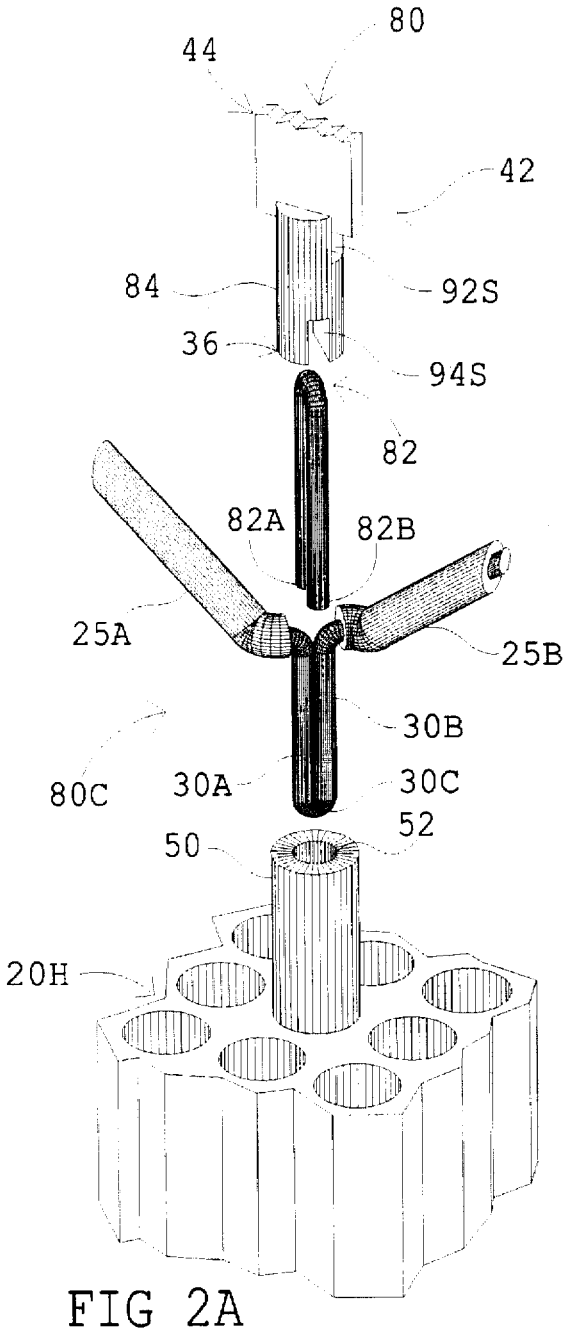
FIG. 2A is a partially exploded perspective view of the FIG. 1A connector and housing, with a U-shaped clamp and modified shoulder sub-assembly replacing the fingers-and-shoulder sub-assembly.
Figure 2C:
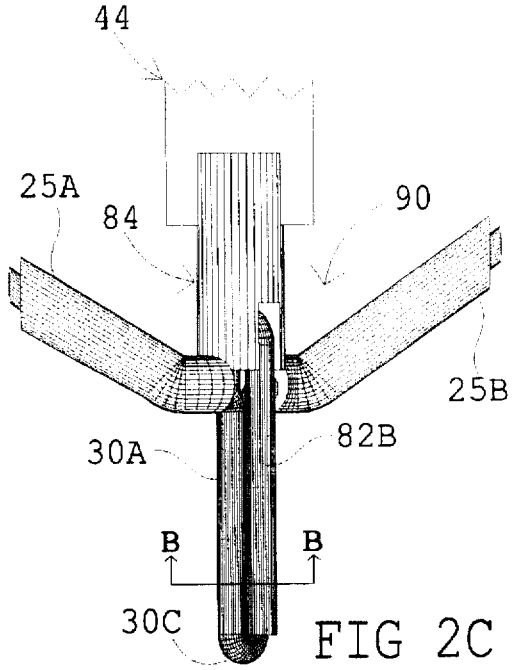
FIG. 2C is a side view of the FIG. 2A wire loop held by the clamp-and-shoulder sub-assembly.
Figure 2D:
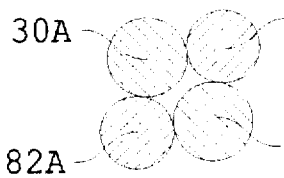
FIG. 2D is an enlarged cross-sectional view taken along line B—B of FIG. 2C.
Figure 2B:
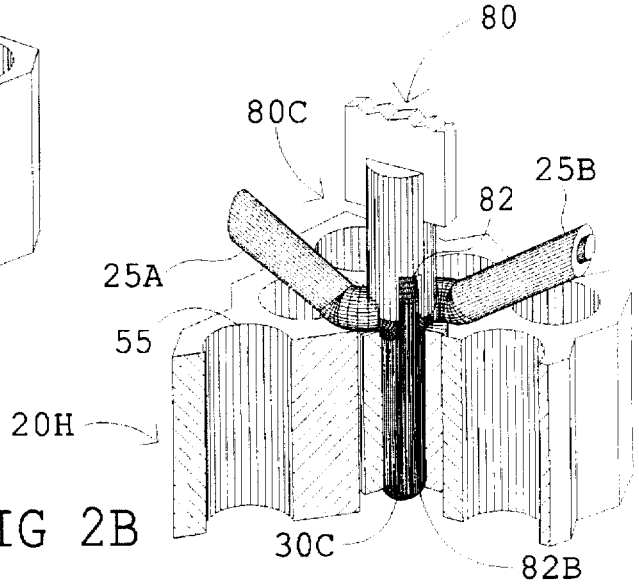
FIG. 2B is a partial sectional view of the FIG. 2A connector, housing, and arm.

Referring to FIGS. 1A, 1B, 1C and 1D, a first embodiment of a multi-unit connector assembly 20 includes a plurality of compression connectors 20C and an electrically conductive and/or magnetically permeable housing 20H. Each connector 20C includes a section of insulated interconnect wire 22 having opposed segments 25A and 25B bounding a segment 25C from which insulation has been removed, baring the wire. Segment 25C is bent in a 180-degree wire-loop 30 having a loop-end 30C disposed between contiguous, parallel bare-wire segments 30A and 30B. Each connector 20C further includes opposed insulating arcuate fingers 32A–32B gripping and rigidly maintaining wire-loop 30. The fingers are attached proximally at a lower end 34 of a generally cylindrical insulating shoulder 36 including an upper end 38 having a slot 38S. Fingers 32A–32B and shoulder 36 thus comprise a fingers-and-shoulder sub-assembly 40. A lower end 42 of a rigid, longitudinally-movable rigid arm 44 is closely received within the slot 38S, so that the fingers-and-shoulder sub-assembly 40, bared wire-loop 30 and insulated wire segments 25A–25B move together longitudinally when arm 44 is moved. Each connector 20C further includes a generally cylindrical sleeve 50 having a generally cylindrical bore 52 serving as a receptacle within which fingers 32A–32B and wire-loop 30 are closely received. Sleeve 50 can be constructed of an insulating material to provide isolation from the ground/shield or be constructed of an electrically conductive material to provide direct connection to the ground/shield. Sleeve 50 is closely received within one of a plurality of generally cylindrical, closely proximate housing receptacles 55 of housing 20H. As shown in FIG. 1B, when connector 20C is fully inserted within housing 20H, insulating shoulder 36 is contiguous to the housing and disposed between wire-segments 25A–25B, and bare-wire segments 30A–30B are insulated from the housing. The particular connector of FIG. 1 is designed to contact an opposing connector element residing near the surface of housing 20H, as best shown in FIG. 1B. Alternate contact positions with the opposing connector element can be configured by increasing or reducing the length of wire-segments 25A–25B and fingers 32A–32B relative to the thickness of sleeve 50 and housing 20H. To contact an opposing connector element that is disposed in a cavity, loop-end 30C can protrude beyond sleeve 50 and housing 20H to extend loop-end 30C to reach the element. To contact a male connector pin requiring a cavity for installation, loop-end 30C can be retracted within sleeve 50 to provide the cavity.

Referring to FIGS. 2A, 2B, 2C and 2D (corresponding respectively to FIGS. 1A, 1B, 1C and 1D), an alternative multi-unit connector assembly 80 according to the first embodiment includes a plurality of compression connectors 80C and an electrically conductive and/or magnetically permeable housing 20H. In this alternative to FIGS. 1A, 1B, 1C and 1D, fingers 32A–32B are replaced by a U-shaped clamp 82 constructed from a rigid piece of wire including an arcuate segment 82C disposed between generally parallel segments 82A–82B. Shoulder 36 is replaced by a generally cylindrical shoulder 84 including an lower end 94 having slot 94S serving as a receptacle closely receiving the contiguous clamp 82. Thus, clamp 82 and shoulder 84 comprise a clamp-and-shoulder sub-assembly 90. Preferably, clamp 82 is fabricated from a stainless steel. Typically, shoulder 84 is fabricated from an electrically non-conductive material, especially if the arm 44 is electrically conductive. Shoulder 84 includes an upper end 92 having a slot 92S which closely receives lower end 42 of arm 44. The clamp-and-shoulder sub-assembly 90, bared wire-loop 30 and insulated wire segments 25A–25B move together longitudinally when arm 44 is moved.

Alternate, longitudinal contact positions with the opposing connector element can be configured by increasing or reducing the length of wire-segments 25A–25B and fingers 32A–32B relative to the height of sleeve 50 and housing 20H. Increasing the length of segments 25A–25B extends loop-end 25C past housing 20C and sleeve 50 while decreasing the length of segments 25A–25B causes loop-end 25C to be recessed within housing 20A and sleeve 50.

Figure 3A:
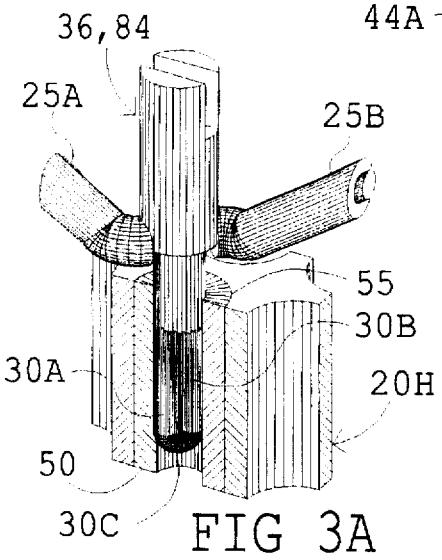
FIG. 3A is a partial sectional view of the first embodiment wherein the wire loop is partially inserted into the sleeve and the sleeve is attached to the housing.
Figure 3B:
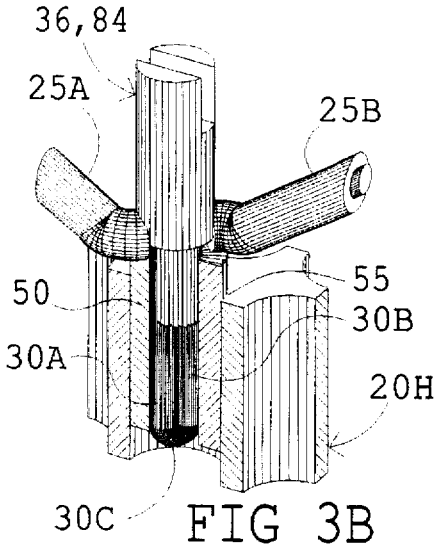
FIG. 3B is a partial sectional view of the first embodiment wherein the wire loop and sleeve are mutually attached and are partially inserted into the housing.
Figure 3C:
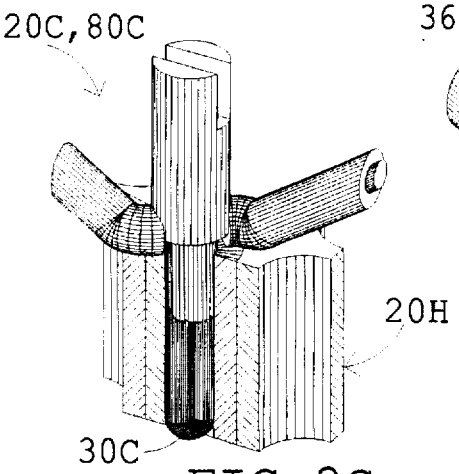
FIG. 3C is a partial sectional view of the FIGS. 3A, 3B shoulder, loop, and housing, wherein the connector is fully inserted into the housing.

For assembly 20 or 80, FIGS. 3A and 3B show alternative configurations of interconnect wire segments 25A–25B and bare-wire segments 30A, 30B and 30C within insulating sleeve 50 and conductive housing 20H. For clarity, the lower portion of fingers 32A–32B or wire clamp 82 are not shown. In FIGS. 3A, 3B, and 3C, interconnect wire segments 25A, 25B, 25C, bare-wire segments 30A–30B, finger/clamp-and-shoulder sub-assembly 40/90, and arm 44 (not shown)all travel longitudinally in unison. In FIG. 3A, sleeve 50 is attached to and stationary within receptacle 55 of housing 20H, where wire segments 25A–25B, shoulder 36 or 84, and wire loop 30 move together longitudinally and recessed within the receptacle. In FIG. 3B, sleeve 50, shoulder 36 or 84, and loop 30 are all attached, moving longitudinally together within receptacle 55. FIG. 3C shows the connector 20C or 80C fully inserted within housing 20H, where loop-end 30C slightly protrudes beneath housing 20H and allowing loop-end 30C to contact the opposing pad, wire loop, or other connector element.

It will be apparent to those skilled in the electronic arts that other sleeve configurations and housing materials can be selected to enhance the performance characteristics of the connector. For example, a highly electrically conductive material can provide electrostatic shielding while electromagnetic shielding can be provided by surrounding the sleeve with magnetically permeable material, such as iron. A combination of shielding materials, such as by stratifying or layering can provide specific electrostatic and electromagnetic characteristics.

Figure 4:
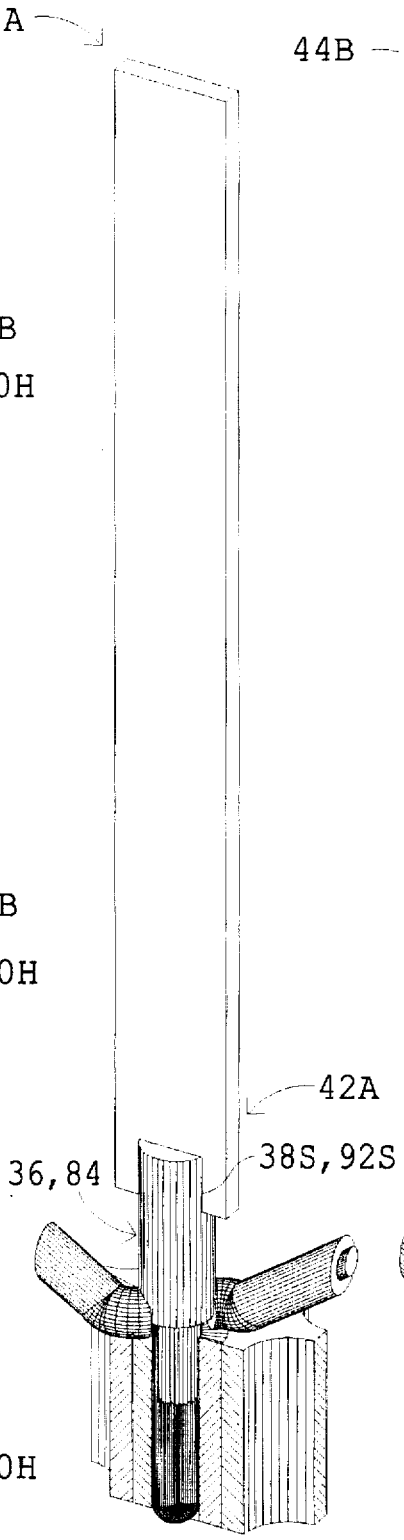
FIG. 4 is a perspective view of a first type of longitudinally movable arm connected to the FIGS. 3A, 3B, 3C shoulder, with the connector (shown in partial sectional view) fully inserted into the housing.
Figure 5:
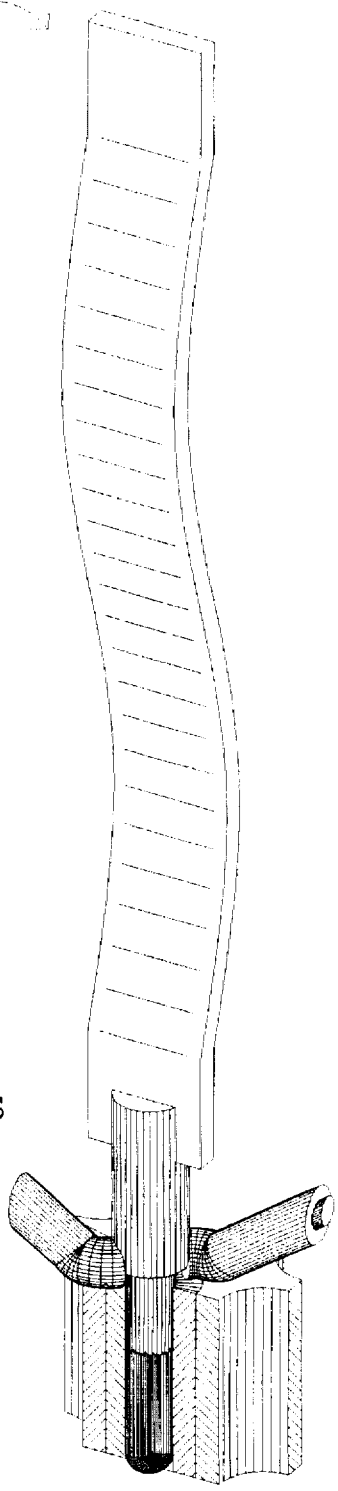
FIG. 5 is a perspective view of a second type of longitudinally movable arm connected to the FIGS. 3A, 3B, 3C shoulder, with the connector (shown in partial sectional view) fully inserted into the housing.

FIG. 4 shows a first type of longitudinally-movable rigid arm 44A whose lower end 42A is closely received within slot 38S in shoulder 36 of connector 20C or within slot 92S in shoulder 84 of connector 80C. Preferably, arm 44A is fabricated from a rigid metallic alloy such as spring steel or beryllium copper. Such a material provides rigidity required of the arm and enhances shielding between neighboring rows of interconnect wiring. When arm 44A is metallic, the shoulder 36 or 84 must be electrically non-conductive so that signals will be electrically isolated from one another. Alternatively, arm 44A can be fabricated from a rigid non-conductive material such as a plastic. FIG. 5 shows a second type of arm 44B having an undulating form which acts to increase arm resilience. Arm 44B can be fabricated from either a metallic or a non-metallic material.

Figure 6A:
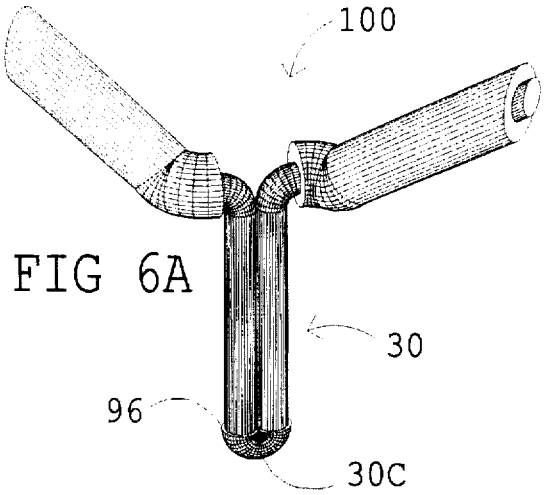
FIG. 6A is a perspective view of an alternative connector including a bare-wire loop with the loop-end having a plated surface.
Figure 6C:
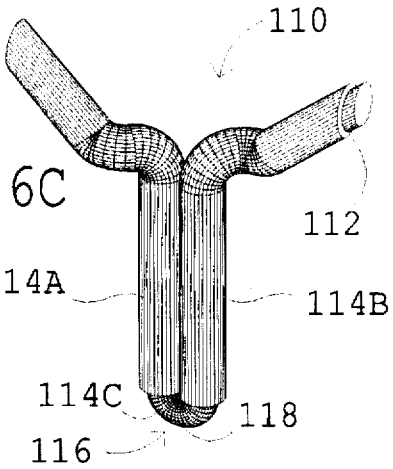
FIG. 6C is a perspective view of an insulated wire loop having a bare-wire loop-end.
Figure 6B:
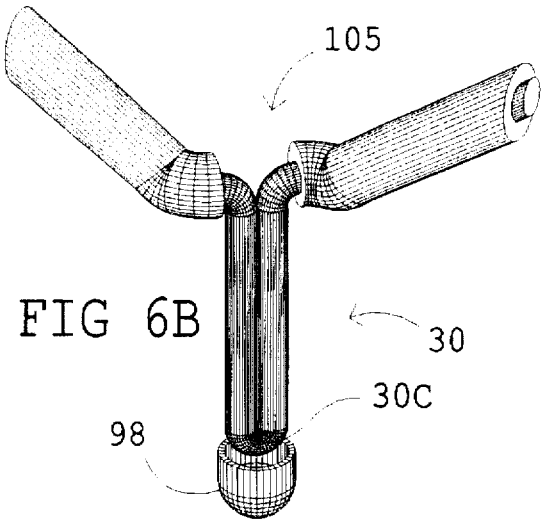
FIG. 6B is a perspective view of the FIG. 6A connector, with a conductive cap fitted over the loop-end.

FIG. 6A shows an alternative connector 100 of connector 20C, 80C with the loop-end 30C plated with a metallic layer 96 to protect the electrical contact area from oxidation. Preferably, the loop-end is plated with a noble metal, such as gold. As shown in FIG. 6B, an alternative connector 105 is fitted with a metallic cap 98 over the loop-end 30C. The cap can be elongated along the length of the bare-wire segments 30A and 30B to increase the rigidity of wire-loop 30. If cap 98 is sufficiently elongated, increased rigidity of wire-loop 30 and increased bonding strength between the wire segments is provided. If a cap is used, the bore of the receptacle will need to be enlarged to accommodate the increased cross section. Connector 110 of FIG. 6C shows a section of magnet wire or other laminated wire having a thin insulation 112 as an alternative to insulated interconnect wire 22. Connector 110 has opposed insulated segments 114–114B bounding a relatively small (compared to segment 25C) bare-wire segment 114C bent in a 180-degree loop 116 having a loop-end 118. Thus, insulation is removed only at and near the loop-end. In such a configuration, the insulation at the loop-end can be removed after the connector has been installed. Post-installation removal of insulation can also be used for wire segments with thicker insulation (such as wire-segments 25A–25B).

Figure 7:
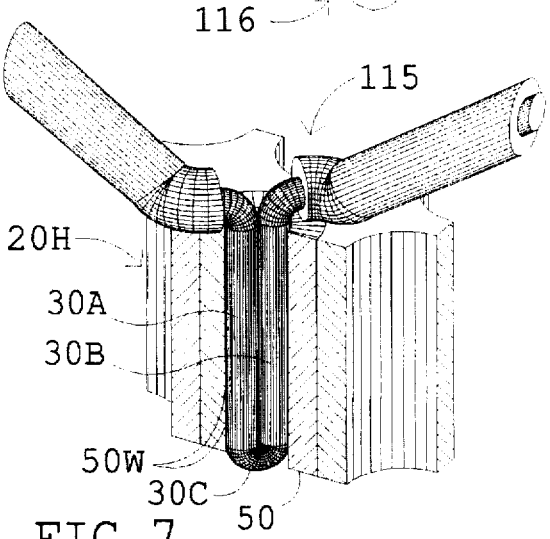
FIG. 7 is a perspective sectional view of a FIG. 3C wire loop attached to the sleeve inner wall.

FIG. 7 shows a simplified compression connector 115 achieved by securing the wire-segments 30A–30B of connectors 20, 80, 100, 105, or 110 directly to the interior wall 50W of a conductive or insulating sleeve 50, preferably by weld or epoxy. Permanent attachment of wire-segments 30A–30B to sleeve 50 eliminates the need for shoulder 36 or 84, fingers 32A–32B or clamp 82, and arm 44. In addition, by using an electrically conductive sleeve and by welding or otherwise electrically bonding an electrically conductive sleeve 50 between wire-segments 30A–30B and housing 20H, a low-resistance and low-inductance path between the formed wire-loop connector and the surrounding ground plane is provided.

Figure 8:
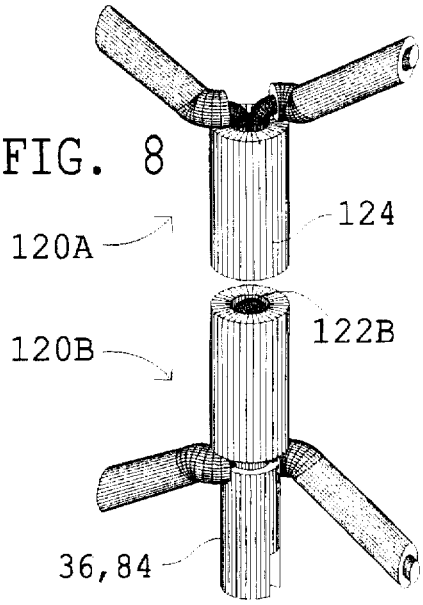
FIG. 8 is a perspective view showing the orientation and approach of two separated contact elements of FIG. 3C and FIG. 7.

FIG. 8 shows two separated compression connectors 120A, 120B each including, respectively, a protruding attached loop-end 122A (not shown) and 122B. Connector 120A is of type 115 and connector 120B can be 20C or 80C. In connector 120A, bare-wire segments 30A (not shown) and 30B (not shown) are attached to sleeve 124, and the sleeve is bonded to a housing (not shown). Connector 120B is attached to a shoulder 36 or 84 attached to an arm 44A or 44B (not shown) which provides longitudinal movement to loop-end 122B. Thus, when loop-end 122B presses against stationary loop-end 122A, electrical contact results from compression of the two loop-ends.

Figure 9:
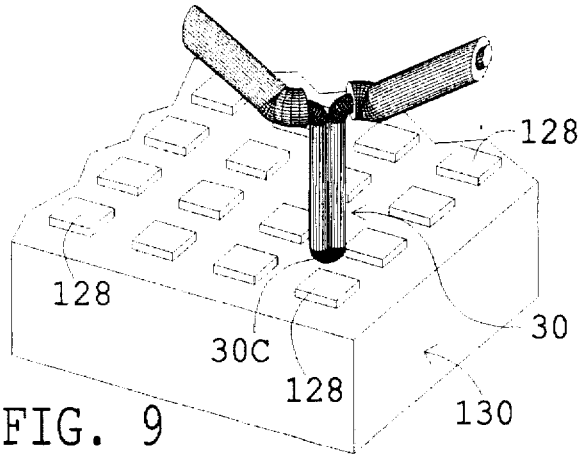
FIG. 9 is a perspective view of a FIG. 3C or FIG. 7 connector whose contact elements are positioned above a pad of a land-grid array device.

FIG. 9 shows a connector 20, 80, 100, 110, or 115 positioned above one of a multiplicity of interconnecting pads 128 of a microelectronic device 130. For clarity, only a single one-to-one relationship between a loop and a pad is shown. However, in a fully configured system each pad could be connected to a corresponding loop. Contact between loop-end 30C and the pad is achieved by vertical movement of either the wire-loop 30 or device 130 until the loop-end is compressed against the pad.

Figure 10:
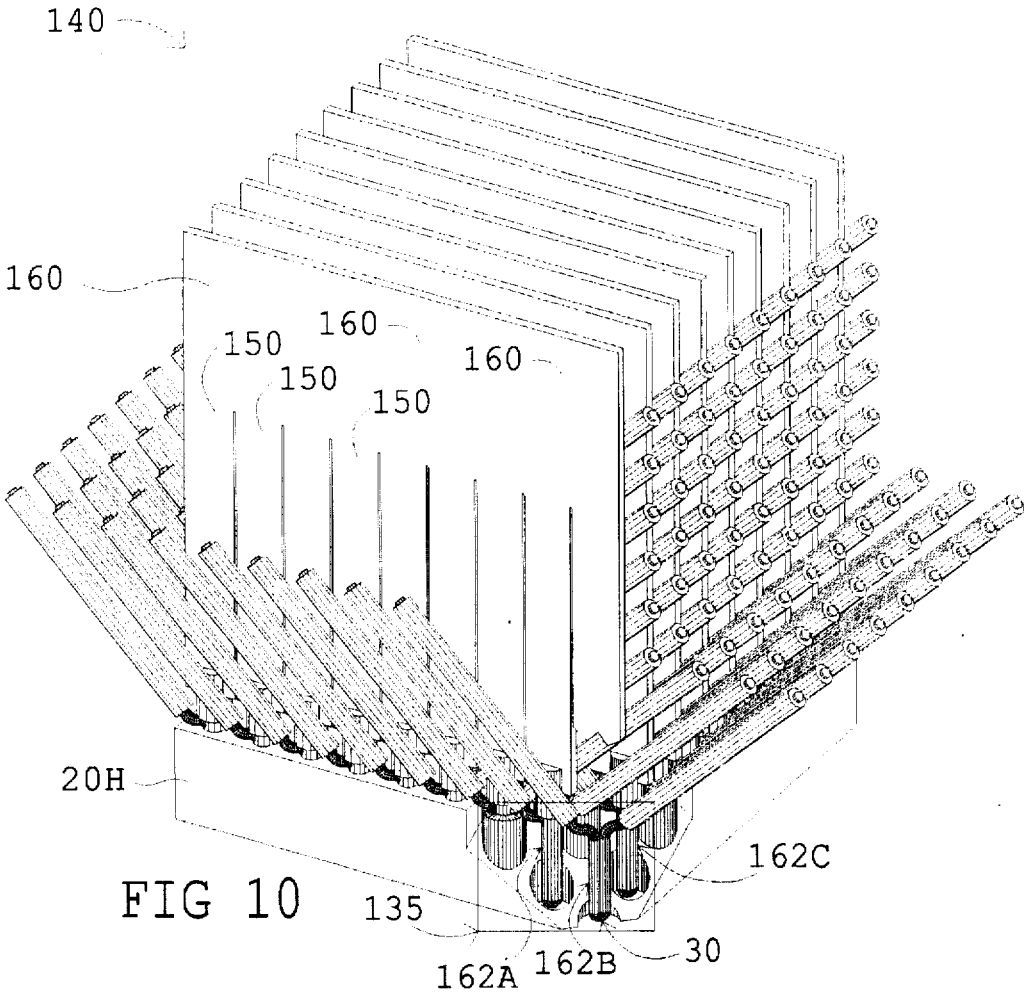
FIG. 10 is a combined perspective and partial sectional view of a multiplicity of first embodiment connector disposed in a three-dimensional array module including a corresponding multiplicity of longitudinally movable arms, interconnect wiring, and a base.
Figure 11:
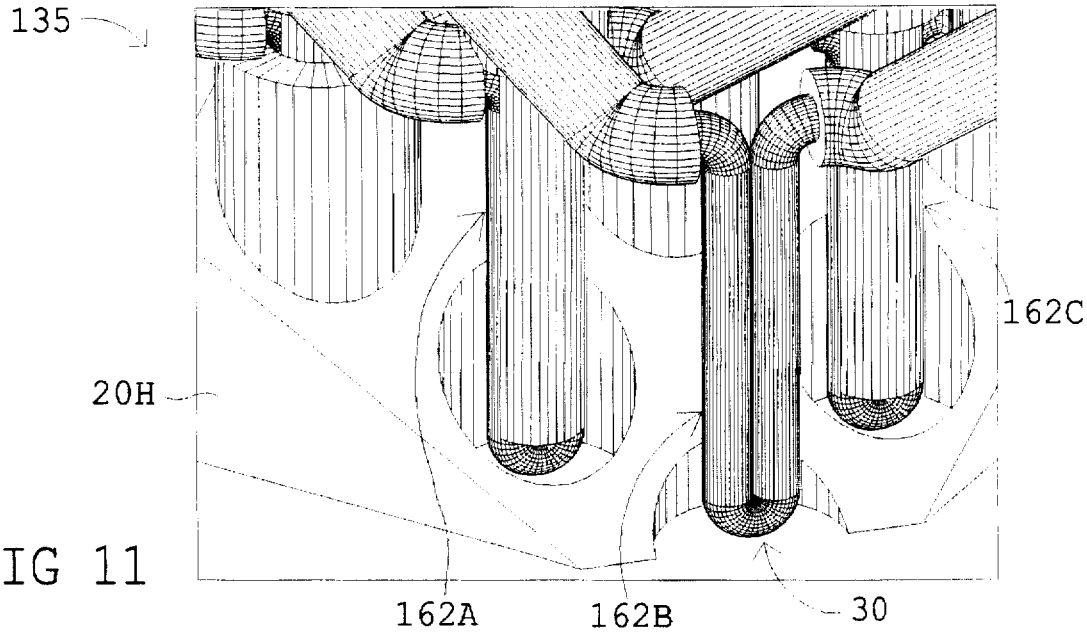
FIG. 11 is a partial sectional view of a FIG. 9 detail region.

Referring to FIG. 10 and a detail view 135 from FIG. 10 shown in FIG. 11, an array module 140 of connectors includes a plurality of connectors 20C and/or 80C of FIG. 1 or 2. The shoulder of each fingers-and-shoulder or clamp-and-shoulder sub-assembly is attached to an individual lower arm 150 having an independent, discrete drive, and each arm 150 is attached to an upper arm 160 so that each sub-assembly is longitudinally provided with uniform contact pressure. For clarity in FIG. 10, an insulating sleeve is omitted for connector assemblies 162A, 162B, 162C, and a wire-loop 30 is shown only for sub-assembly 162B.

Figure 12:
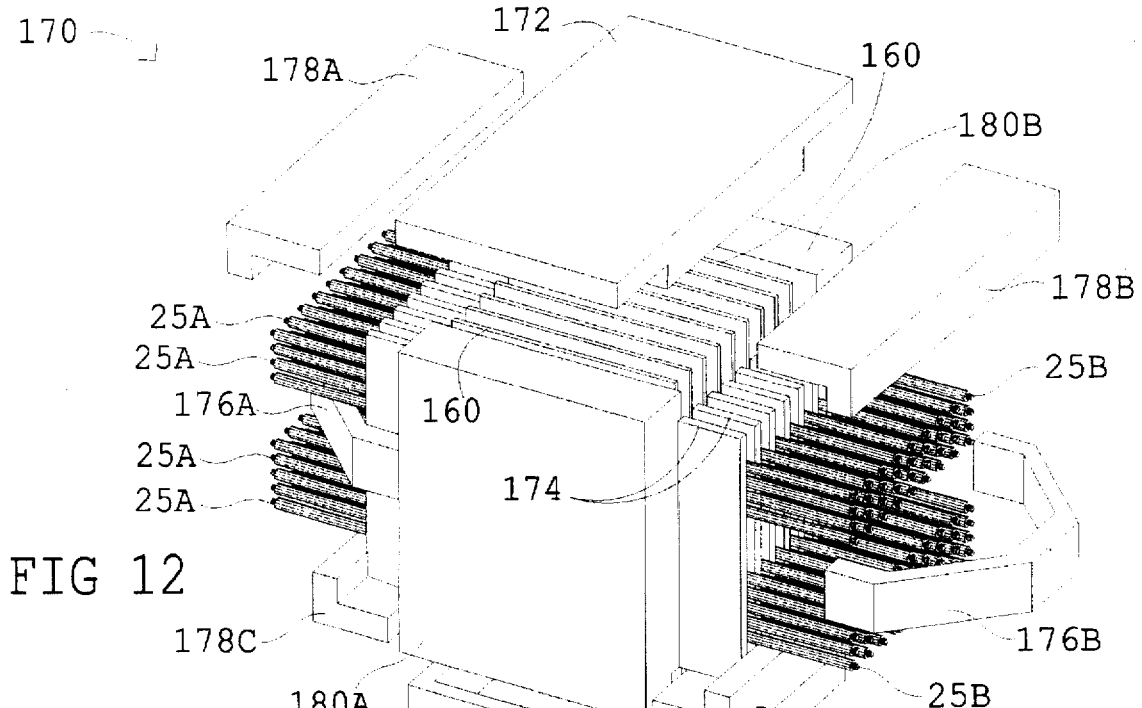
FIG. 12 is an exploded perspective view of structural components of a housing enclosing and supporting the FIG. 10 module.

FIG. 12 shows an array module housing 170 enclosing and supporting the module 140 of FIG. 10. Housing 170 includes a pressure plate 172 which presses against the upper arm 160 to drive the array of loop-end contacts 30C (not shown. A plurality of wire restraint/stress-relief plates 174, secured by clamps 176A–176B sandwich the columns of interconnect wires 25A–25B. Housing 170 further includes stress-relief plate retainers 178A, 178B, 178C, 178D which hold the stress-relief plates 174 in place. Opposed side plates 180A, 180B is unified with stress-relief plate retainers 178A–178B when array module housing 170 is assembled. A guide 190 fitting around conductive housing 20H (not shown) and the outline of the opposing connector (not shown) aligns the opposing electronic or connector elements with each other.

Figure 13:
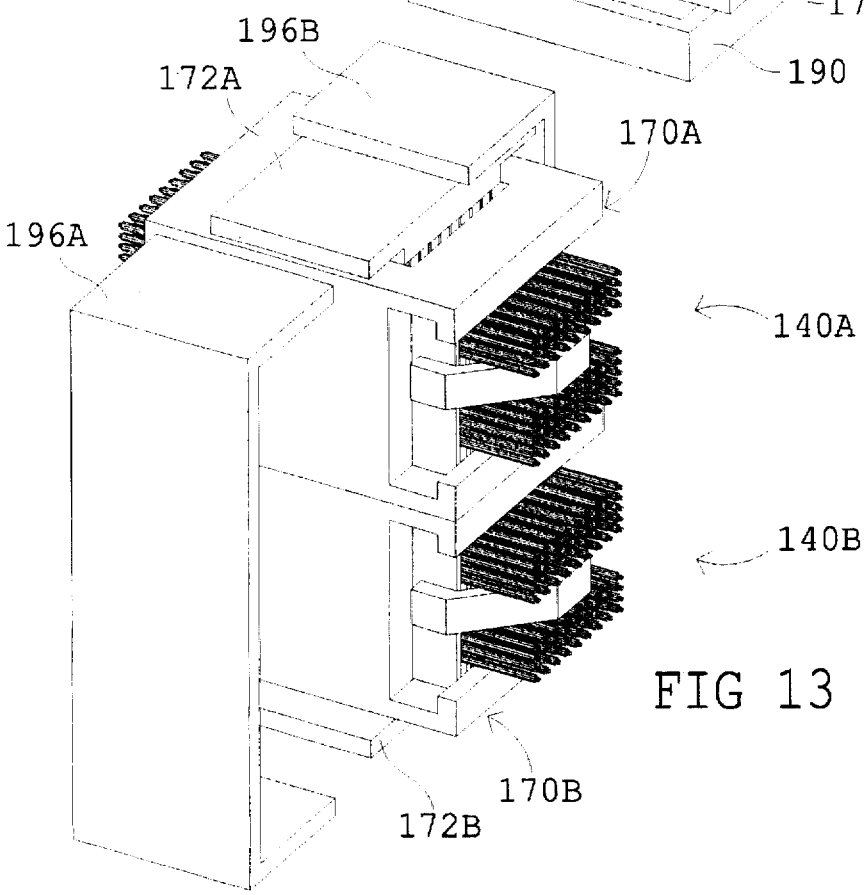
FIG. 13 is a perspective view of two juxtaposed FIG. 12 modules and housings.

FIG. 13 shows two juxtaposed array modules 140A, 140B enclosed, respectively, by module housings 170A, 170B with a plurality of signal/wire contact elements between the two cable assemblies 194A (not shown), 194B (not shown). Assemblies 178A, 178B, 178C, 178D, 180A, and 180B are unified from FIG. 12 and pressure plates 172A and 172B are positioned to apply pressure on the connector elements. One possible means of applying pressure to the opposed pressure plates 172A and 172B is by use of opposed clamp fixtures 196A (shown laterally displaced for viewing) and 196B.

It will be apparent to those skilled in the microelectronic packaging arts that other array module and housing configurations can be devised which drive or apply pressure to the arms 160 and/or 150, provide strain relief for the interconnect wiring, and ensure contact alignment between opposing assemblies.

III. SECOND PREFERRED EMBODIMENT

Figure 14A:
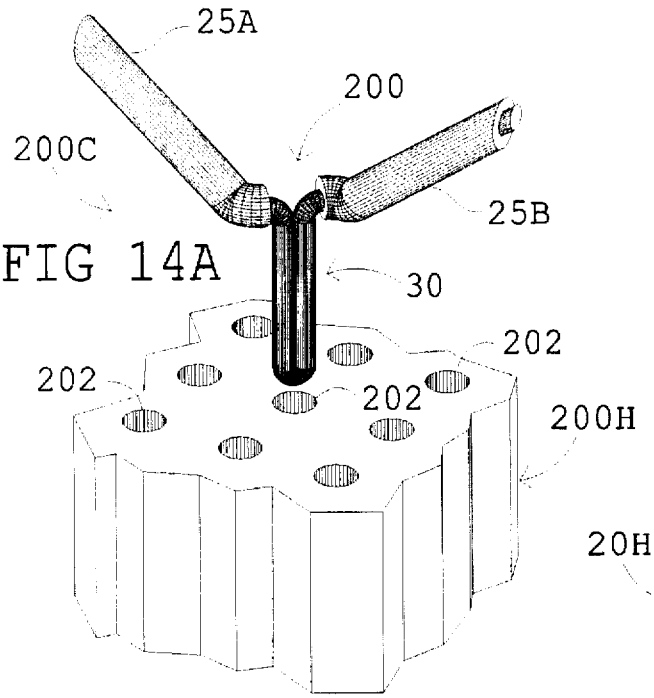
FIG. 14A is an exploded perspective view of a second embodiment connector assembly, showing an exemplary connector situated above a receptacle located in an insulating housing, the connector including a wire loop.
Figure 14B:
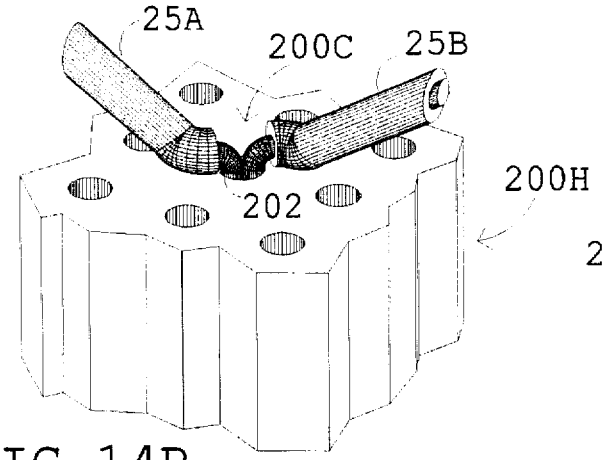
FIG. 14B is a perspective view of the FIG. 14A connector inserted into the housing receptacle.

Referring to FIGS. 14A and 14B, a second embodiment of a multi-unit connector and housing assembly 200 includes a plurality of compression connectors 200C and an electrically non-conductive housing 200H having a plurality of generally cylindrical, closely proximate receptacles 202. Each connector 200C includes the wire segments 25A–25B, and wire-loop 30. Because of the reduced footprint of the second embodiment, receptacles 202 in housing 200 can provide a higher density array per unit area than the receptacles 55 in housing 20H. The differences between the first and second embodiment are the size of receptacles 55 and 202, and that the second embodiment does not require a sleeve 50. Many enhancements and modifications as defined with the first embodiment can be applied to the second embodiment. These include floating and driving wire-loop 30 with fingers 32A–32B or clamp 82, as used with connector assembly 20C or 80C. Wire-segments 30A–30B can be bonded or welded to the inner wall of receptacle 202 of housing 200H, similar in fashion to the bond or weld of loop 30A–30B to sleeve 50 of FIG. 7. In addition, loop-end 30C can be plated with a noble metal 96, similar to connector 100 of FIG. 6A, be fitted with a cap 98 similar to connector 105 of FIG. 6B, or using the thin insulated wire 112 as shown with connector assembly 110 of FIG. 6C.

IV. THIRD PREFERRED EMBODIMENT

Figure 15:
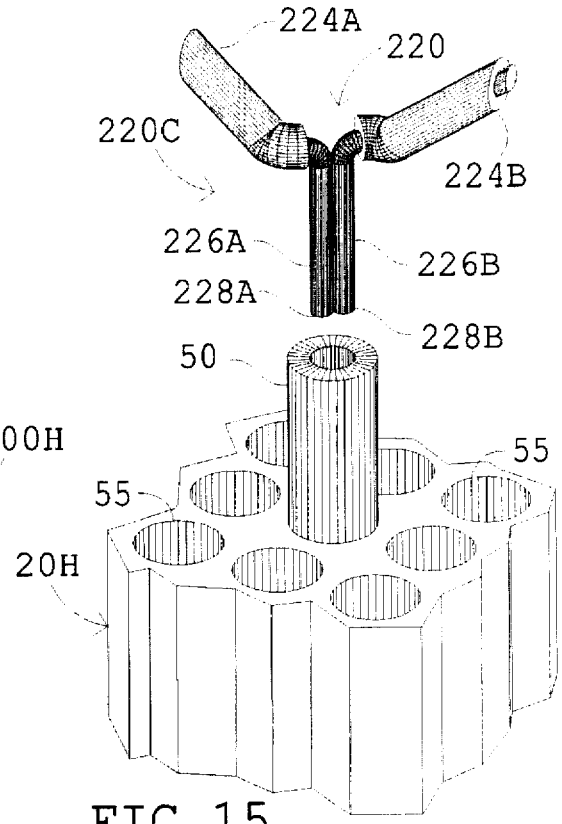
FIG. 15 is a partially exploded perspective view of a third embodiment of a connector assembly, showing an exemplary connector situated above a sleeve and the sleeve situated above a conductive housing, the connector including two adjacent, parallel wires bonded together.

Referring to FIG. 15, a third embodiment of a multi-unit connector assembly 220 includes a plurality of compression connectors 220C and electrically conductive and/or magnetically permeable housing 20H having a plurality of generally cylindrical, closely proximate receptacles 55. The same housing as used in the first embodiment can be used in the third embodiment. Each connector 220C includes two insulated wires 224A–224B terminating in contiguous, parallel bare-wire segments 226A–226B, respectively, having ends 228A–228B. Thus, separate wire segments 226A–226B are used instead of a continuous length of wire formed into a loop as utilized in bare-wire segments 30A, 30B, and loop-end 30C of the first and second embodiment. Preferably, the segments are soldered or welded together to provide an integral, unified assembly.

Figure 16:
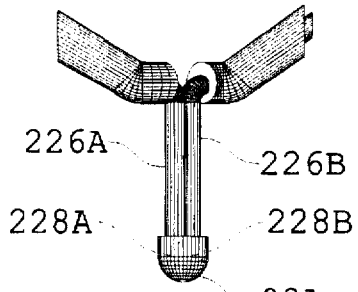
FIG. 16 is an side view of the FIG. 15 connector with a conductive cap fitted over the wire ends.

Other enhancements and modifications as defined with the first embodiment can apply to the third embodiment. These include floating and driving connector bare-wire segments 226A–226B with fingers/clamp 32A–32B or 82, shoulder 36 or 84, and arm 44A or 44B, in a manner similar to driving loop-end 30A, 30B, and 30C of connector assembly 20C or 80C. Segments 226A–226B can be bonded or welding to sleeve 50, in a manner similar to connector 115 of FIG. 7. Bare-wire segments ends 228A–228B can be plated with a noble metal 96 similar to loop-end 30C of FIG. 6A, or be fitted with a cap 98A of FIG. 16 to increase the rigidity of the connector or to protect wire-ends 228A–228B. In addition, thin insulated wire as shown with connector assembly 110 in FIG. 6C can be applied to the third embodiment. As a final adaptation of connector 220C, even though two wires having two bare-wire segments are shown in FIG. 15, it will be evident that alternative configurations can include more than two segments.

V. FOURTH PREFERRED EMBODIMENT

Figure 17:
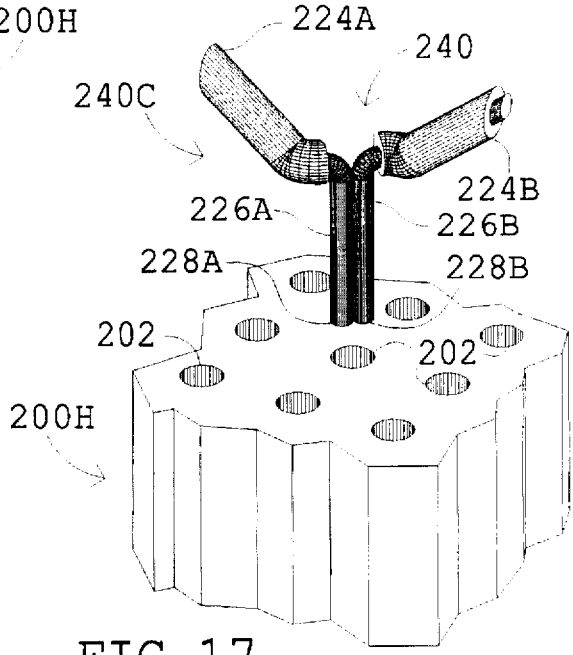
FIG. 17 is an exploded perspective view of a fourth embodiment of a connector assembly, showing an exemplary connector situated above a receptacle in an insulating housing, the connector including two adjacent, parallel wires bonded together.

Referring to FIG. 17, a fourth embodiment of a multi-unit connector and housing assembly 240 includes a plurality of compression connectors 240C and an insulating housing 200H having a plurality of generally cylindrical, closely proximate receptacles 202, such as used in assembly 200. As in the third embodiment, each connector 240C includes two insulated wires 224A–224B terminating in contiguous, parallel bare-wire segments 226A–226B, respectively, having ends 228A–228B, respectively. Also, as with the third embodiment, segments 226A–226B are soldered or welded together to provide a integral, unified assembly.

Many other enhancements and modifications as defined with the first, second, or third embodiment can apply to the fourth embodiment. These include floating and driving connector bare-wire segments 226A–226B with fingers 32A–32B or clamp 82, bonding or welding wire-segments 226A–226B to housing 200H, plating wire-ends 228A–228B with a noble metal 96, or be fitted with a cap 98A of FIG. 16. In addition, the thin insulated wire 112 as shown with connector assembly 110 of FIG. 6C can be applied, and alternative configurations can include more than two wire segments.

In all configurations, the gauge of wire used can be tailored to meet the requirements of each connection, such as maximum permissible electrical current, voltage rating, resistance, shielding level, and characteristic impedance. Use of higher-gauge (i.e., finer) wire allows higher connector density at the expense of limiting current capability and increasing signal attenuation. Use of heavier gauge wire allows larger currents at the expense of reduced connector density.

The present invention can be manufactured using an environmentally-safe process as no chemicals are required to etch or electroplate electrical junctions. Pieces of removed insulation are the only byproduct.

What is claimed is:

1. An electrical connector and housing assembly comprising:

a plurality of wire loops each having a bare-wire loop-end disposed between contiguous first and second generally parallel bare-wire segments;

a plurality of generally cylindrical sleeves each having a bore within which one of said wire loops is disposed, the bore forming a sleeve inner surface;

means for closely receiving, gripping and rigidly maintaining the loop within its sleeve; and an electrically conductive housing having a plurality of generally cylindrical receptacles, each of said sleeves closely received within one of said receptacles.

2. The connector and housing assembly of claim 1 further comprising means for inserting the loop into and retracting the loop from the sleeve bore.

3. The connector and housing assembly of claim 2 wherein the cylindrical sleeve is constructed of an insulating material.

4. The connector and housing assembly of claim 3 wherein:

said means for closely receiving, gripping and rigidly maintaining the loop comprises opposed first and second arcuate fingers having a common predetermined length; and said means for inserting the loop into and retracting the loop from the sleeve bore comprises an insulating shoulder having opposed upper and lower ends, the lower end attached to said fingers, the upper end attached to a longitudinally movable arm.

5. The connector and housing assembly of claim 1 wherein said means for closely receiving, gripping and rigidly maintaining the loop within its sleeve comprises a mechanical bond between the bare-wire segments and sleeve inner surface.

6. The connector and housing assembly of claim 1 wherein the cylindrical sleeve is constructed of an electrically conductive material.

7. The connector and housing assembly of claim 6 wherein said means for closely receiving, gripping and maintaining the loop within its sleeve comprises a mechanical bond between the bare-wire segments and sleeve inner surface.

8. The connector and housing assembly of claim 1 wherein at least one loop-end is plated with a noble metal.

9. The connector and housing assembly of claim 1 wherein at least one loop-end is encompassed by a conductive cap.

10. An electrical connector and housing assembly comprising:

a plurality of contiguous first and second generally parallel bare-wire segments of a common predetermined length, each segment terminating in a lower end, each pair of segments attached along their lengths;

a plurality of generally cylindrical sleeves each having a bore within which one of said segment pairs is disposed, the bore forming a sleeve inner surface;

means for closely receiving, gripping and rigidly maintaining each segment pair within its sleeve; and an electrically conductive housing having a plurality of generally cylindrical receptacles, each of said sleeves closely received within one of said receptacles.

11. The connector and housing assembly of claim 10 further comprising means for inserting the segment pair into and retracting the segment pair from the sleeve bore.

12. The connector and housing assembly of claim 11 wherein the cylindrical sleeve is constructed of an insulating material.

13. The connector and housing assembly of claim 12 wherein:

said means for closely receiving, gripping and rigidly maintaining each segment pair comprises opposed first and second arcuate fingers having a common predetermined length less than the segment common length; and said means for inserting the segment pair into and retracting the segment pair from the sleeve bore comprises an insulating shoulder having opposed upper and lower ends, the lower end attached to said fingers, the upper end attached to a longitudinally movable arm.

14. The connector and housing assembly of claim 10 wherein said means for closely receiving, gripping and rigidly maintaining the segment pair within its sleeve comprises a mechanical bond between the bare-wire segments and sleeve inner surface.

15. The connector and housing assembly of claim 10 wherein the cylindrical sleeve is constructed of an electrically conductive material.

16. The connector and housing assembly of claim 15 wherein said means for closely receiving, gripping and rigidly maintaining the segment pair within its sleeve comprises a mechanical bond between the bare-wire segments and sleeve inner surface.

17. The connector and housing assembly of claim 10 wherein the lower ends of at least one segment pair are plated with a noble metal.

18. The connector and housing assembly of claim 10 wherein the lower ends of at least one segment pair are encompassed by a conductive cap.

* * * * *